US005819891A

United States Patent [19]

Wang et al.

[11] Patent Number: 5,819,891

[45] Date of Patent: Oct. 13, 1998

[54] RETRACTABLE LUGGAGE WITH AN EXTENDABLE HANDLE

[76] Inventors: Yuan Liang Wang; Chi Chen Lung, both of P.O. Box 82-144, Taipei, Taiwan

[21] Appl. No.: 363,946

[22] Filed: Dec. 27, 1994

[51] Int. Cl.[6] ..... A45C 5/14; A45C 7/00; A45C 13/28

[52] U.S. Cl. ..... 190/103; 190/18 A; 190/39; 190/105; 190/115; 16/115; 280/37; 280/655.1

[58] Field of Search ..... 280/37, 655, 655.1; 190/18 A, 29, 115, 103–105; 16/115

[56] References Cited

U.S. PATENT DOCUMENTS

| | | | |
|---|---|---|---|
| 1,241,210 | 9/1917 | Harvey | 190/104 |
| 2,699,848 | 1/1955 | Kaplan | 190/105 |
| 4,361,215 | 11/1982 | Sawai | 190/103 X |
| 4,618,035 | 10/1986 | Mao | 190/18 A |
| 4,733,759 | 3/1988 | Shih-Chen | 190/103 X |
| 4,844,215 | 7/1989 | Ambasz | 190/104 |
| 4,887,751 | 12/1989 | Lehman | 190/103 |
| 4,995,487 | 2/1991 | Plath | 190/115 X |
| 5,082,094 | 1/1992 | Nechushtan | 190/105 |
| 5,108,119 | 4/1992 | Huang | 190/18 A X |
| 5,167,306 | 12/1992 | Carrigan, Jr. | 190/18 A |
| 5,374,073 | 12/1994 | Hung-Hsin | 190/18 A X |
| 5,393,079 | 2/1995 | Wang | 280/37 |

FOREIGN PATENT DOCUMENTS

| | | | |
|---|---|---|---|
| 125337 | 11/1984 | European Pat. Off. | 280/655 |
| 2015114 | 10/1971 | Germany | 190/105 |
| 265658 | 2/1927 | United Kingdom | 190/105 |
| 530302 | 12/1940 | United Kingdom | 190/103 |
| 678514 | 9/1952 | United Kingdom | 190/115 |

*Primary Examiner*—Sue A. Weaver
*Attorney, Agent, or Firm*—A & J

[57] ABSTRACT

A retractable luggage with an extendable handle includes a retractable bag including a base plate, an extendable handle assembly having an inverted U-shaped member, a pair of inner tubular members, a pair of outer tubular members, a pair of split collars, a pair of sleeves, and a pair of plugs, the inner tubular members being fixedly mounted on the base plate, the sleeves having a tubular portion inserted in an upper end of the inner tubular members, a center hole for receiving a lower end of the inverted U-shaped member, a flange with a plurality of slits, and a pair of protuberances adapted to engage holes of the inner tubular members and having a slit at both sides thereof, the outer tubular members fitted over the inner tubular members, the split collars having a tubular portion inserted into an upper end of the outer tubular members, a flange at one end, a groove under the flange, and a pair of protuberances under the groove adapted to engage holes of the outer tubular members, the plugs being fitted in the inner tubular member and connected with a lower end of the inverted U-shaped member.

2 Claims, 10 Drawing Sheets

RETRACTABLE LUGGAGE WITH AN EXTENDABLE HANDLE

BACKGROUND OF THE INVENTION

It has been found that the conventional retractable luggage case generally includes a flexible body portion which utilizes zippers to shorten the height thereby reducing the volume. However, such a piece of retractable luggage case on the market is provided with an extendable handle thus making it inconvenient to use.

Therefore, it is an object of the present invention to provide a retractable luggage with an extendable handle which can obviate and mitigate the above-noted drawbacks.

SUMMARY OF THE INVENTION

This invention relates to a retractable luggage with an extendable handle.

It is the primary object of the present invention to provide a retractable luggage with an extendable handle.

It is another object of the present invention to provide a retractable luggage with an extendable handle which can be operated steadily and smoothly.

It is still another object of the present invention to provide a retractable luggage with an extendable handle which can keep the handle firmly at an extended or retracted position.

It is still another object of the present invention to provide a retractable luggage with an extendable handle which is convenient in use.

It is a further object of the present invention to provide a retractable luggage with an extendable handle which is fit for practical use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
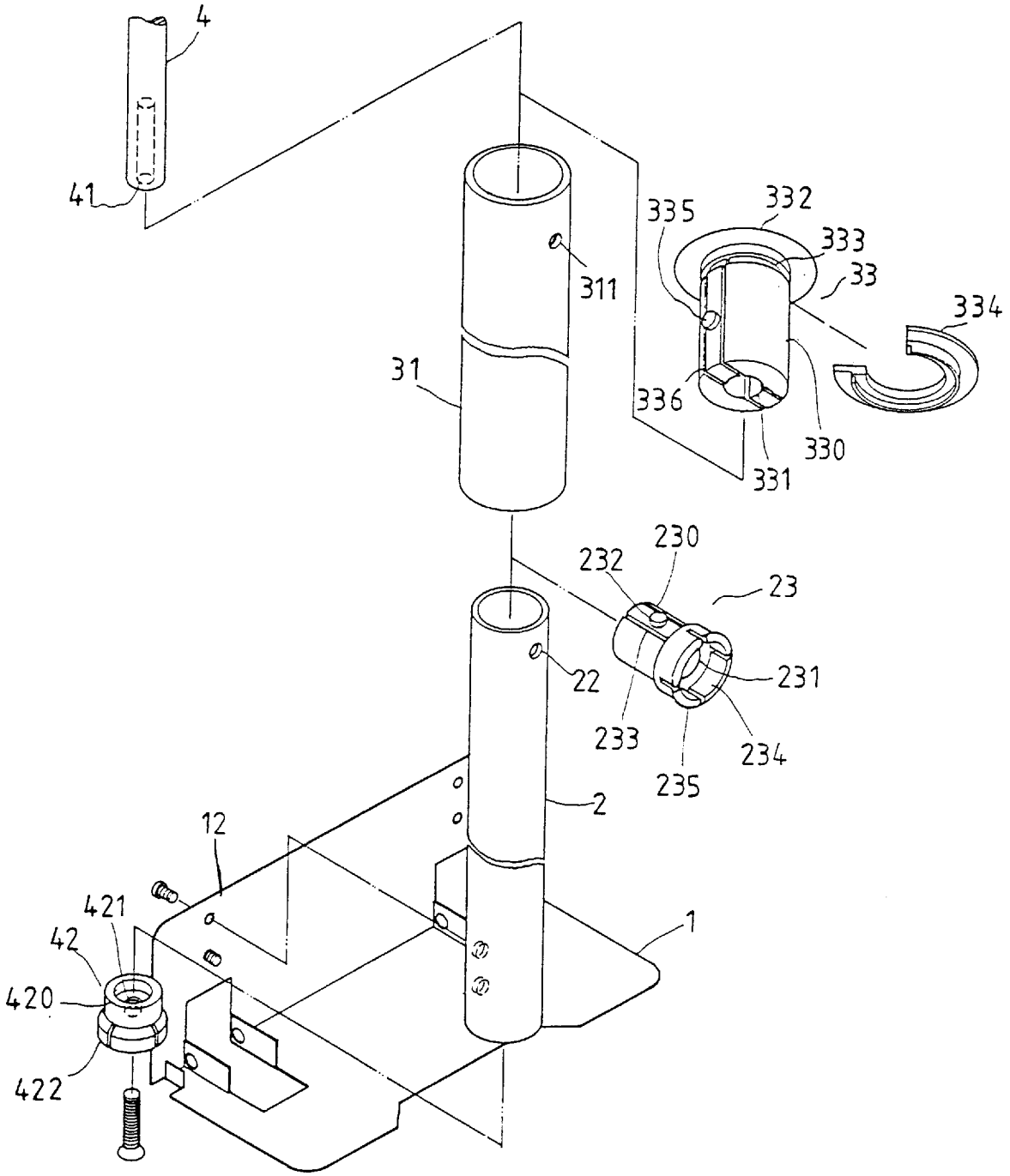
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the present invention mainly comprises a retractable bag and an extendable handle assembly. The extendable handle assembly includes an inverted U-shaped member 4, a pair of inner tubular members 2, a pair of outer tubular members 3, a pair of split collars 33, a pair of sleeves 23, and a pair of plugs 42.

The retractable bag A includes an L-shaped base plate 1 having a vertical portion 12 on which are secured the lower ends of the inner tubular members 2. The upper end of the inner tubular member 2 is formed with a pair of holes 22. The sleeve 23 includes a tubular portion 230 the outer diameter of which is the same as the inner diameter of the inner tubular member 2. The tubular portion 230 is formed with a center hole 231 adapted to receive the lower end of the inverted U-shaped member 4. Further, the tubular portion 230 is provided at the top end with a flange 235 divided into a plurality of portions by slits at the top end and a pair of protuberances 232 adapted to engage the holes 22 of the inner tubular member 2. On both sides of the protuberance 232 there is a slot 233 thus forming a resilient portion.

The outer tubular member 3 is put over the inner tubular member 2 and is shorter than the inner tubular member 2. The upper end of the outer tubular member 3 is formed with a pair of fixing holes 311 and engaged with the split collar 33. The split collar 33 includes a tubular portion 330 having a center hole 331 with the same diameter as the lower end of the inverted U-shaped member 4. The tubular portion 330 is formed at one end with a flange 332, a groove 333 under the flange 332 adapted to engage a C-retainer 334, and a pair of protuberances 335 adapted to engage the holes 311 of the outer tubular member 31. On both sides of the protuberance 335 there is a slot thus forming a resilient portion.

The inverted U-shaped member 4 includes two legs each having a threaded hole 41 and connected with a plug 42 by a screw. The plug 42 is fitted into the inner tubular member 2. The plug 42 includes a tubular portion 420 having a center threaded hole 421 engageable with a screw and a flange 422 divided into a plurality of portions by slits thereby providing the flange 422 with resiliency. The flange 422 is slightly larger than the inner diameter of the inner tubular member 2 in diameter and can be fitted therein.

Figure 2:
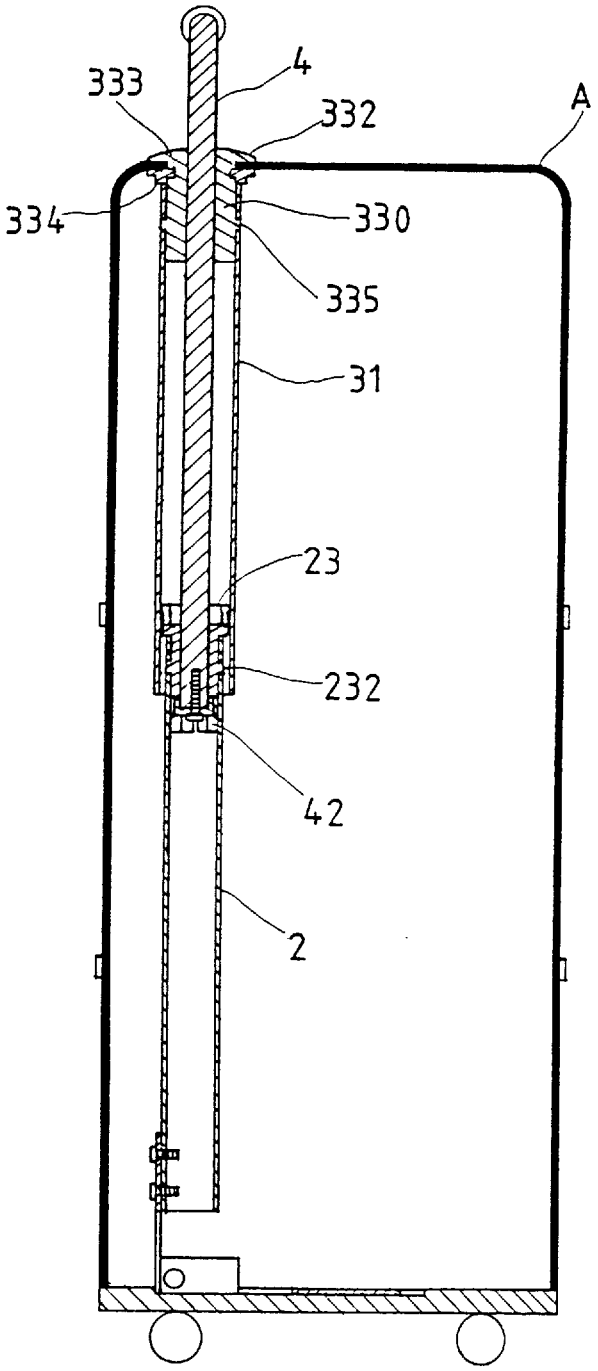
FIG. 2 shows the present invention in the expanded position with the handle assembly shown in vertical cross-section.
Figure 3:
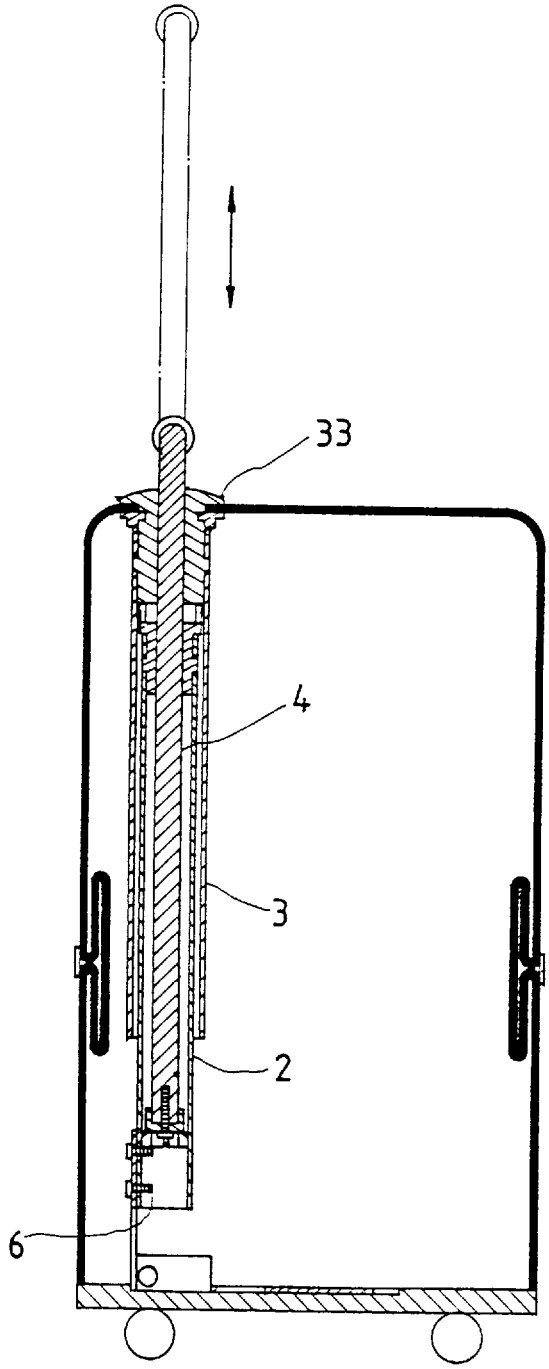
FIG. 3 shows the present invention in the contracted condition with the handle assembly shown in vertical cross-section and extended in broken lines.

As shown in FIG. 2, the top of the retractable bag A is fitted between the split collar 33 and the C-retainer 334. FIG.

3 shows the relative positions of the component parts when the retractable bag A and the inverted U-shaped member are retracted.

Figure 4:
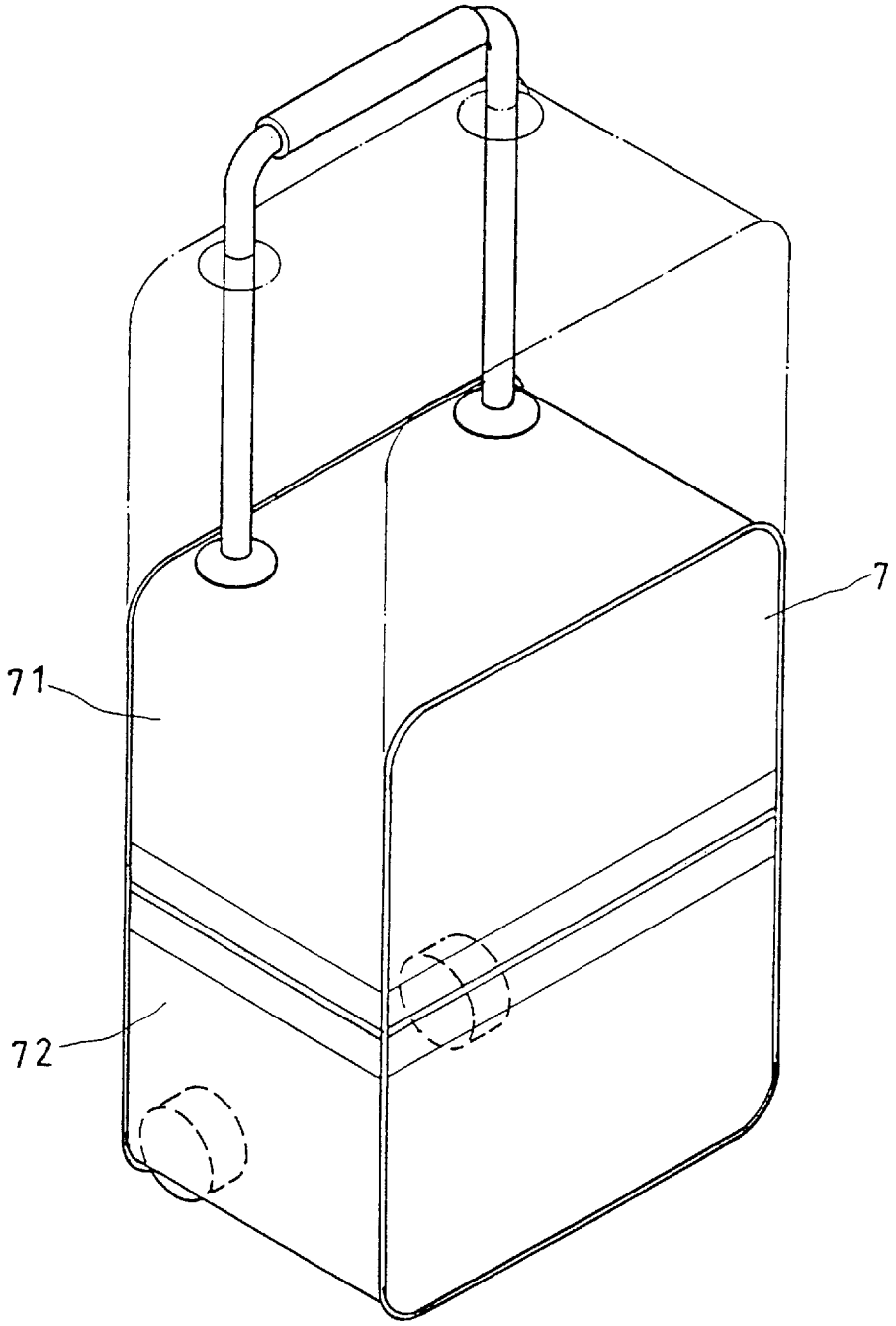
FIG. 4 shows the second embodiment of the present invention.

FIG. 4 shows an application of the present invention to retractable luggage. As shown in FIGS. 4, 8, 9 and 10, the retractable luggage is divided into an upper chamber 71 and a lower chamber 72. The upper chamber 71 is provided with a flange 711 having a groove 7111, while the lower chamber 72 has a slot 721 for receiving the flange 711 of the upper chamber 71 and a notch 722. A clamping means 723 is used to connect the upper chamber 71 with the lower chamber 72.

Figure 5:
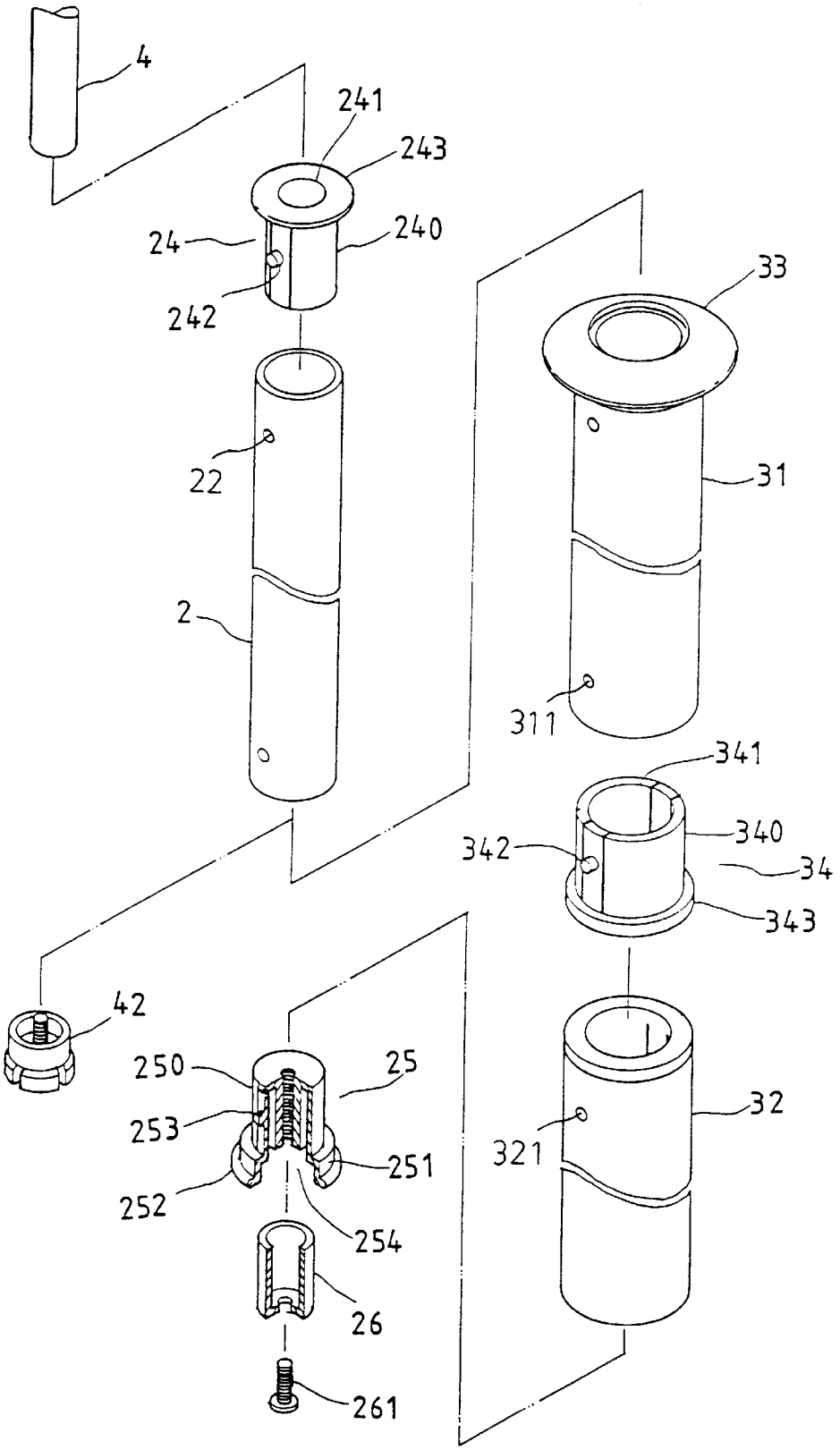
FIG. 5 shows the third embodiment of the present invention.

FIG. 5 shows an application of the present invention to a three-step handle. As illustrated, an intermediate plug 24 is first inserted into the inner tubular member 2 and then the lower end of the inverted U-shaped member 4 is fitted into the intermediate plug 24. The intermediate plug 24 includes a tubular portion 204 having an outer diameter equal to the inner diameter of the inner tubular member 2, a center hole 241 for receiving the lower end of the inverted U-shaped member 4, and a pair of protuberances 242. Both sides of the protuberance 242 there is a slit thereby providing a resilient portion. The upper end of the intermediate plug 24 has a flange 243 for preventing the intermediate plug 24 from completely going into the outer tubular member 31. The lower end of the inverted U-shaped member 4 is connected with the plug 42. The lower end of the outer tubular member 3 is engaged with an outer plug 34. The outer plug 34 includes a tubular portion 340 having a flange 343 at the lower end and a pair of protuberances 342 adapted to engage the holes 311 of the outer tubular member 3. On both sides of the protuberance 342 there is a slot thus forming a resilient portion. A second outer tubular member 32 has a lower end mounted on a base plate of the bag and connected at the upper end with the flange 343 of the outer diameter plug 34. A stopper 25 is fitted into the upper end of the second tubular member 32 and engaged with the outer plug 34. The stopper 25 includes a tubular portion 250 formed with a flange 252 having an outer slightly larger than the inner diameter of the second outer tubular member 32 and a shoulder 251 adapted to engage the outer plug 34. The stopper 25 is force-fitted into the second outer tubular member 32. Further, the stopper 25 has a pair of protuberances 253 adapted to engage the holes at the lower end of the inner tubular member 2. The stopper 25 has a recess 254 for receiving a cylinder 26 which is kept therein by a screw 261.

Figure 6:
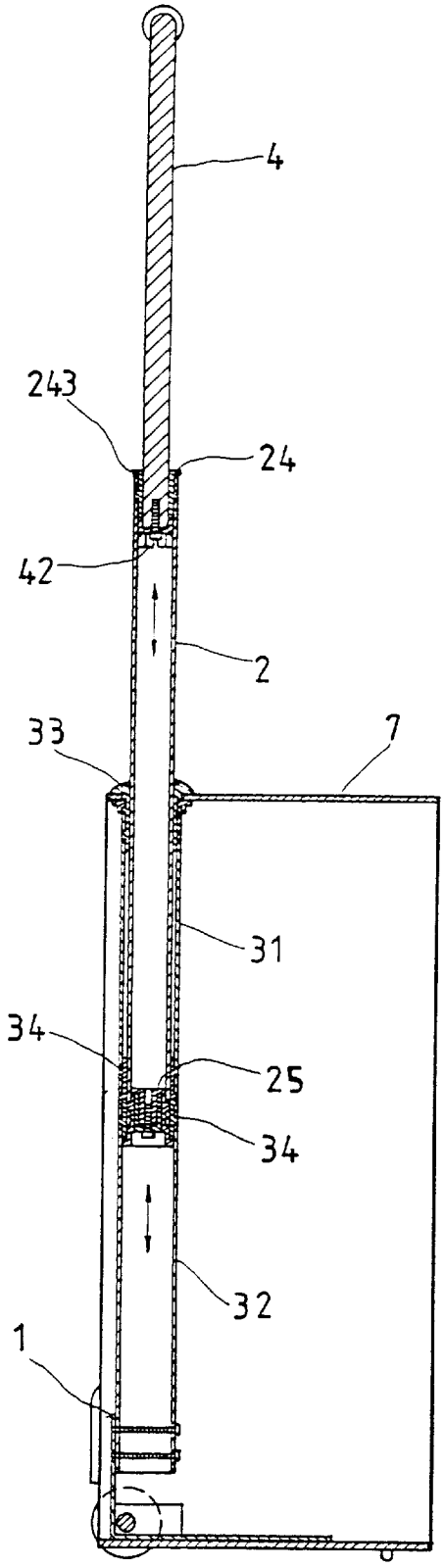
FIG. 6 shows the present invention in the extended condition with the handle assembly shown in vertical cross-section.
Figure 7:
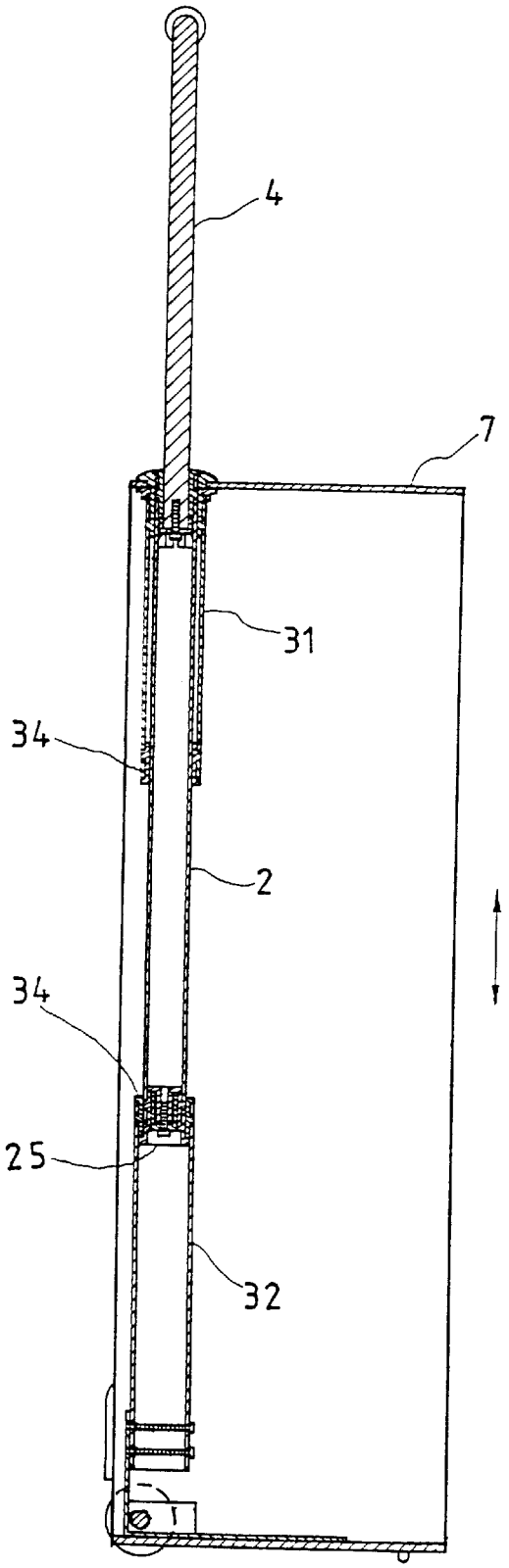
FIG. 7 shows the present invention in the expanded position with the handle assembly shown in vertical cross-section.
Figure 8:
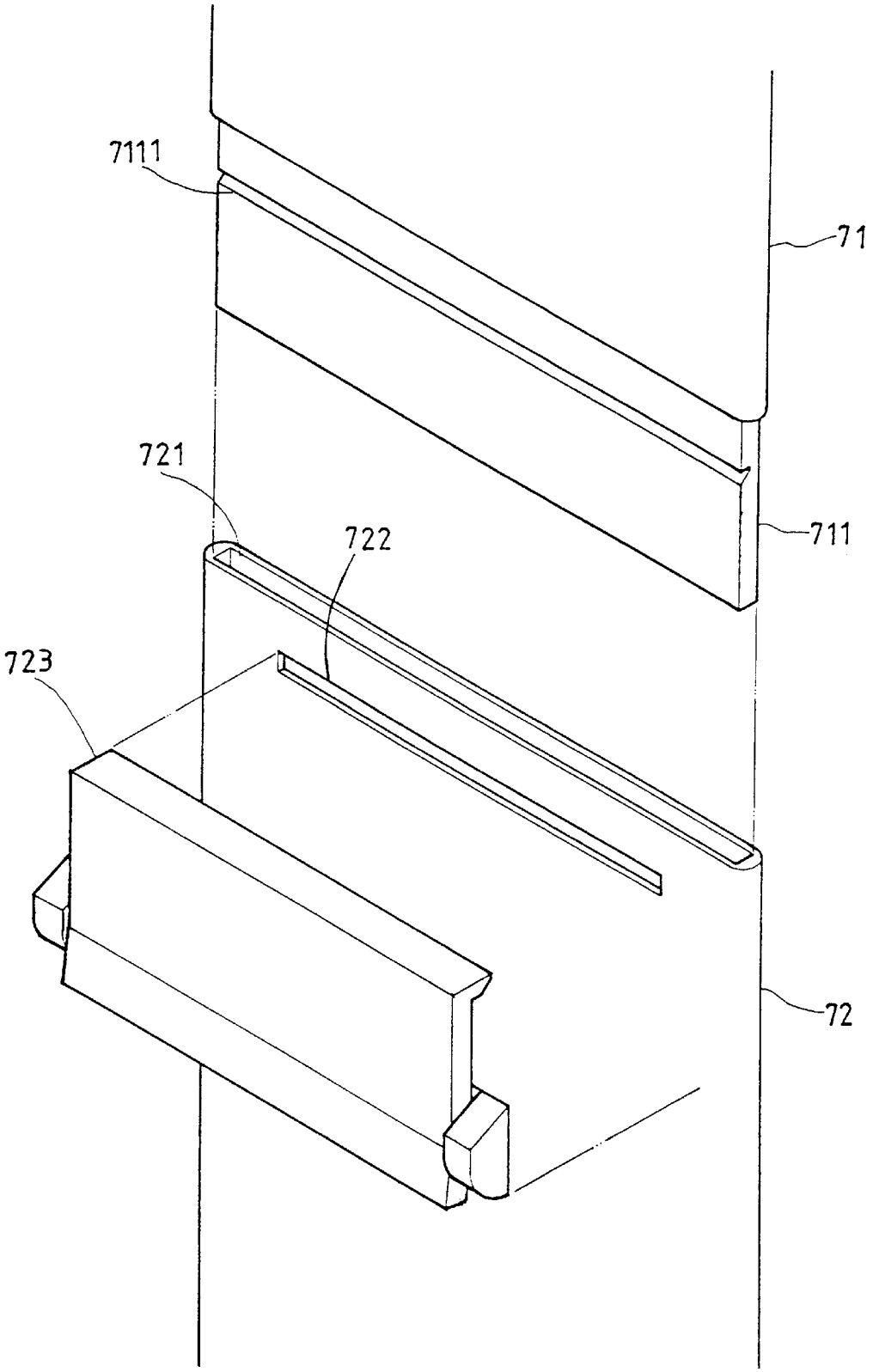
FIG. 8 shows an exploded view of a portion of the telescoping sections of the second embodiment of the luggage case.
Figure 10:
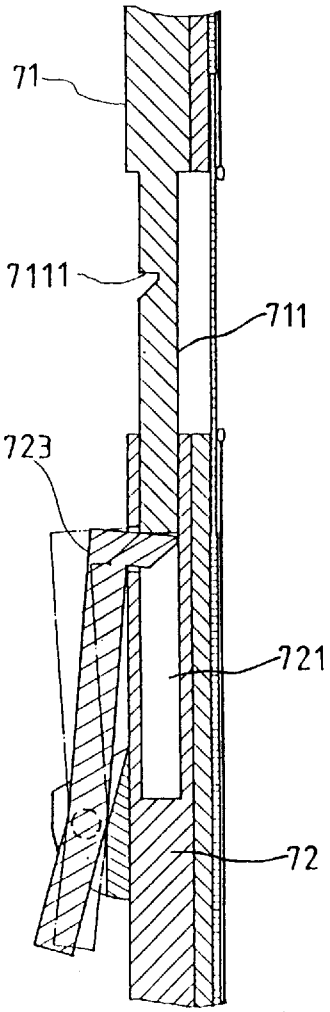
FIG. 10 shows an enlarged sectional view of telescoping portions of the second embodiment of the luggage case in an expanded position.
Figure 9:
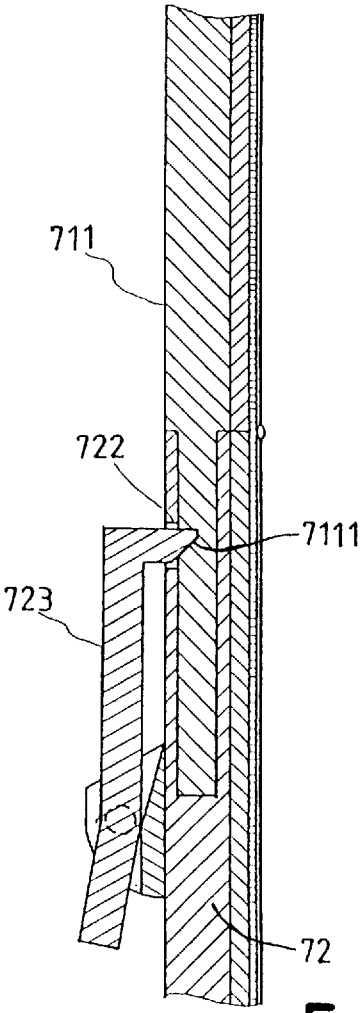
FIG. 9 shows an enlarged sectional view of the telescoping portions of the second embodiment of the luggage case in the contracted position.

As can be seen in FIGS. 6 and 7, the inverted U-shaped member 4 can slide within the inner tubular member 2 which can in turn move along the second outer tubular member 32. Further, the outer tubular member 3 can slide with respect to the inner tubular member 2.

Figure 11:
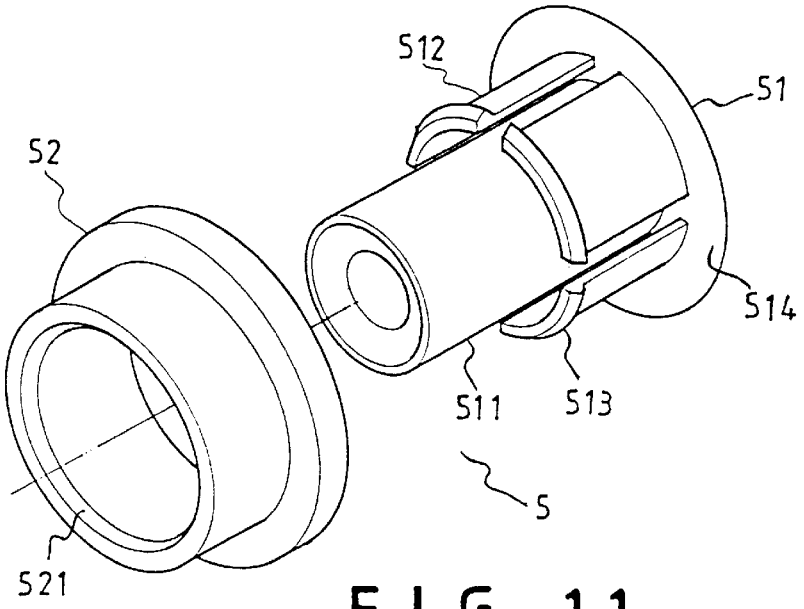
FIG. 11 shows an exploded view of a second embodiment of the split collar.
Figure 12:
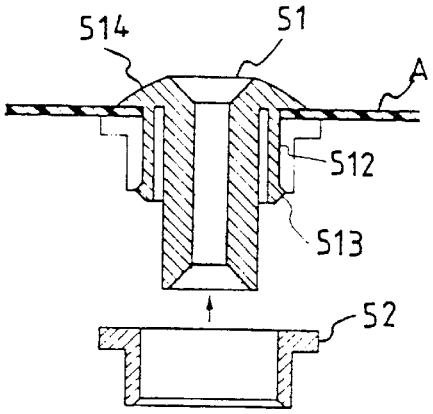
FIG. 12 shows a view in vertical cross-section of the second embodiment of the collar on a luggage case.
Figure 13:
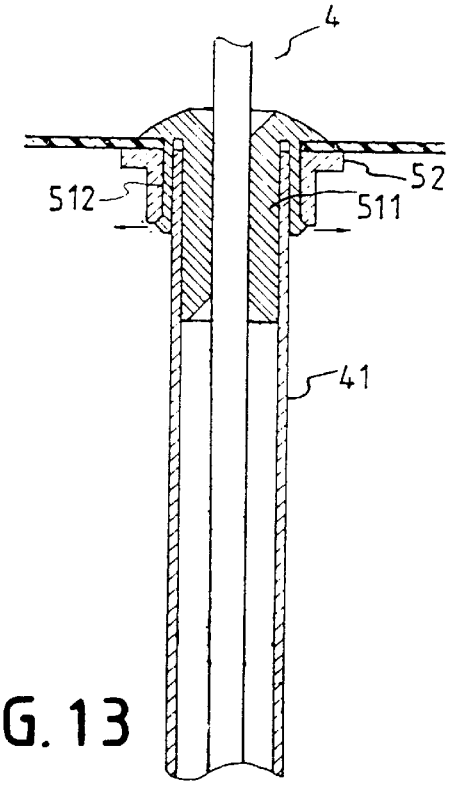
FIG. 13 shows a vertical sectional view of the second embodiment of the collar in assembled position on the handle assembly.

FIGS. 11, 12 and 13 show a second preferred embodiment of the split collar. As illustrated, the split collar is replaced with a fitting member 5 including an annular member 52 and a head member 51. The head member 61 is formed with a tubular portion 511 and a flange 514 at the top of the tubular portion 511. From the flange 514 downwardly depend a plurality of leaves 512 each having a hook edge 513. The annular member 52 has a center hole adapted to receive the leaves 512 of the head member 51 and is formed with an inclined surface 521 at the outer edge.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

We claim:

1. A retractable luggage case with an extendable handle comprising:

a vertically expandable and retractable bag including an upper chamber and a lower chamber including means for expansion and retraction, said means including a flange having a groove disposed in a member in said upper chamber and a slot disposed in a member in said lower chamber, said slot dimensioned and disposed for receiving said flange, a notch in the member of said lower chamber communicating with the slot and a clamping means disposed on said lower chamber member and dimensioned and disposed to be received in the notch and groove when the bag is in the vertically retracted position and the flange is received in the slot, the lower chamber further including a base plate; and a vertically extendable handle assembly including an inverted U-shaped member, a pair of inner tubular members, a pair of outer tubular members, a pair of split collars, a pair of sleeves, and a pair of plugs;

each of said inner tubular members dimensioned to be slidably fitted within a respective one of said outer tubular members and including means for mounting a lower end of said inner tubular members on said base plate;

each or said sleeves having a tubular portion dimensioned to be inserted in an upper end of a respective one of said inner tubular members, a center hole for receiving a lower end of said inverted U-shaped member, a flange with a plurality of slits, and a pair of protuberances adapted to engage holes at an upper end of said inner tubular members and having a slit at both sides thereof;

each of said outer tubular members dimensioned to be fitted over a respective one of said inner tubular members and sleeves;

each of said split collars having a tubular portion dimensioned to be inserted into an upper end of a respective one of said outer tubular members, a flange at an end, a groove under said flange, and a pair of protuberances under said groove adapted to engage holes of said outer tubular members, said split collars being received in openings in a top of said bag to secure said outer tubular members within said bag;

each of said plugs dimensioned to be fitted in a respective one of said inner tubular members and including means for connecting with a lower end of said inverted U-shaped member.

2. A retractable luggage case with an extendable handle comprising:

a vertically expandable and retractable bag including an upper chamber and a lower chamber including means for expansion and retraction, said means including a flange having a groove disposed in a member in said upper chamber and a slot disposed in a member in said lower chamber, said slot dimensioned and disposed for receiving said flange, a notch in the member of said lower chamber communicating with the slot and a clamping means disposed on said lower chamber member and dimensioned and disposed to be received in the notch and groove when the bag is in the vertically retracted position and the flange is received in the slot, the lower chamber further including a base plate; and a vertically extendable handle assembly including an inverted U-shaped member, a pair of inner tubular members, a pair of first outer tubular members, a pair of second outer tubular members, each of said second outer tubular members including means for mounting a lower end of said outer tubular members on said base plate, first and second pairs of outer plugs each, including a tubular portion with a through hole dimensioned to receive one of the inner tubular members and having a flange at a lower end thereof and four longitudinal slots forming two opposite sections each formed with a protuberance thereon, each of said first pair of outer plugs dimensioned to be inserted into an upper end of a respective one of said second outer tubular members with said protuberance engaged with a hole at an upper end of a respective one of said second tubular members, each of said second pair of outer plugs dimensioned to be inserted into a lower end of a respective one of said first outer tubular members with said protuberance engaged with a hole at a lower end of a respective one of said first outer tubular members, a pair of stoppers each including a tubular portion formed with a flange having an outer diameter slightly larger than an inner diameter of a respective one of said second outer tubular members, each of said stoppers being force-fitted into a respective one of said second outer tubular members and the tubular portion being dimensioned to receive one of the inner tubular members and having a pair of protuberances adapted to engage with holes at a lower end of a respective one of said inner tubular members, a pair of split collars each hating a tubular portion dimensioned to be inserted into an upper end of a respective one of said first outer tubular members, a flange at an end, a groove under said flange, and a pair of protuberances under said groove adapted to engage holes of said upper end of said first outer tubular members, said split collars being received in openings in a top of said bag to secure said first outer tubular members within said bag, a pair of intermediate plugs each including a tubular portion having an outer diameter equal to an inner diameter of a respective one of said inner tubular members, a center hole for receiving a lower end of said inverted U-shaped member, and a pair of protuberances adapted to engage with holes at an upper end of a respective one of said inner tubular members, and a pair of plugs each dimensioned to be fitted in a respective one of said inner tubular members but being larger than the center hole of the intermediate plug and connected with a lower end of said inverted U-shaped member.

* * * * *